US007695114B2

(12) United States Patent
Koda et al.

(10) Patent No.: US 7,695,114 B2
(45) Date of Patent: Apr. 13, 2010

(54) INKJET HEAD AND METHOD OF PRODUCING THE SAME

(75) Inventors: Tomohiko Koda, Ibaraki (JP); Satoru Tobita, Ibaraki (JP); Takashi Sato, Ibaraki (JP); Yoshinari Suzuki, Ibaraki (JP)

(73) Assignee: Ricoh Printing Systems, Ltd., Tokyo (JP)

( * ) Notice: Subject to any disclaimer, the term of this patent is extended or adjusted under 35 U.S.C. 154(b) by 565 days.

(21) Appl. No.: 11/676,560

(22) Filed: Feb. 20, 2007

(65) Prior Publication Data

US 2007/0195130 A1 Aug. 23, 2007

(30) Foreign Application Priority Data

Feb. 20, 2006 (JP) ..... 2006-042602

(51) Int. Cl.
*B41J 2/045* (2006.01)

(52) U.S. Cl. ..... 347/68; 347/71

(58) Field of Classification Search ..... 347/68, 347/70–72

See application file for complete search history.

(56) References Cited

U.S. PATENT DOCUMENTS 6,666,547 B1 * 12/2003 Takahashi et al. ..... 347/70
7,568,783 B2 * 8/2009 Katayama ..... 347/42

FOREIGN PATENT DOCUMENTS

JP 63-015755 1/1988
JP 63-265647 11/1988
JP 11-179900 7/1999

* cited by examiner

*Primary Examiner*—An H Do
(74) *Attorney, Agent, or Firm*—Ladas & Parry LLP

(57) ABSTRACT

A disclosed inkjet head includes an ink channel unit formed by stacking a channel plate having a nozzle hole formed therein, a channel plate having a pressure chamber formed therein, and a channel plate having a restrictor formed therein and by bonding the channel plates together by diffusion bonding, which channel plates have substantially the same thickness; a pressure generating source attached to a surface of the ink channel unit and configured to generate pressure to jet ink; and a housing formed by stacking housing plates and by bonding the housing plates together by diffusion bonding and configured to hold the ink channel unit, which housing plates have substantially the same thickness as that of the channel plates.

11 Claims, 16 Drawing Sheets

INKJET HEAD AND METHOD OF PRODUCING THE SAME

BACKGROUND OF THE INVENTION

1. Field of the Invention

The present invention generally relates to an inkjet head, and more particularly relates to an inkjet head and a method of producing the inkjet head where an ink channel unit and a housing for holding the ink channel unit are formed by stacking metal plates.

2. Description of the Related Art

Conventional inkjet heads are intended to be used with inks that do not degrade the parts constituting the conventional inkjet heads and the adhesives bonding those parts together. In these years, however, inkjet heads have come to be used, for example, to produce liquid crystal displays and to form wiring patterns. For such industrial purposes, inks with strong acidity are used. Such inks may degrade channel plates of an inkjet head and adhesives bonding the channel plates together. To cope with this problem, inkjet heads having chemical resistance against strongly acidic inks are being developed.

For example, in one inkjet head, a chemical resistant stainless steel is used for all channel plates that form flow paths for ink (ink channels) and the channel plates are bonded together by diffusion bonding instead of by adhesives. In this case, channel plates can be produced at a low cost by etching. Also, channel plates made of the same stainless steel show a substantially uniform thermal expansion coefficient and therefore it becomes easier to bond the channel plates together by diffusion bonding at a high temperature.

In an inkjet head production method, a stainless steel plate used as a diaphragm plate is bonded by diffusion bonding onto another stainless steel plate in which pressure chambers are formed (see, for example, patent document 1).

According to a description in patent document 1, since no adhesive is used for bonding the above stainless plates together, pressure generated by a piezoelectric element in the produced inkjet head is not absorbed by an adhesive layer and therefore can be efficiently transmitted to the ink. In patent document 1, however, methods of bonding other parts are not described.

Patent document 2 discloses an inkjet head produced by using diffusion bonding (see patent document 2). However, in patent document 2, diffusion bonding is used for bonding only some of the parts constituting the disclosed inkjet head.

Patent document 3 discloses a method of producing an inkjet head where all of the channel plates are bonded together by diffusion bonding. In patent document 3, a pressure plate for holding an ink channel unit is also bonded by diffusion bonding. The channel plates described in patent document 3 are formed by pressing instead of etching.

[Patent document 1] Japanese Patent Application Publication No. 63-265647

[Patent document 2] Japanese Patent Application Publication No. 63-15755

[Patent document 3] Japanese Patent Application Publication No. 11-179900

In the inkjet head production method disclosed in patent document 1, diffusion bonding is used only for a part of the ink channel unit and other parts such as the housing are bonded by an adhesive. Therefore, in an inkjet head produced according to patent document 1, adhesive layers made of the adhesive may be degraded by a strongly acidic ink.

In the inkjet head production methods disclosed in patent documents 2 and 3, the thicknesses of stacked metal plates and the process of stacking the metal plates are not clearly described. Therefore, it seems difficult to accurately stack very thin metal plates with the disclosed production methods.

Also, in patent document 3, channel plates produced by pressing metal plates are used. However, if the channel plates are stacked and bonded together without removing burrs and without correcting distortion generated in the pressing process, adhesion between the channel plates or the bonding reliability may be reduced. Also, if only the areas where the burrs are formed are ground, the thickness of the ground areas may change and, as a result, the bonding reliability is reduced.

Meanwhile, a disadvantage of bonding metal plates by diffusion bonding is that it requires a long time. Also, in an inkjet apparatus, multiple inkjet heads are normally used and arranged in a row at certain intervals. Therefore, it is preferable to produce multiple inkjet heads at once by bonding multiple sets of parts in one process.

When bonding multiple sets of parts in one process, the difference in thickness of the parts is preferably within plus or minus 1 μm and therefore the parts must be processed with high precision. Also, to produce channel plates and housing plates with such high precision, for example, by pressing, many complicated steps are required. This, in turn, causes the production costs to increase.

SUMMARY OF THE INVENTION

The present invention provides an inkjet head and a method of producing the inkjet head that substantially obviate one or more problems caused by the limitations and disadvantages of the related art.

An embodiment of the present invention provides an inkjet head that includes an ink channel unit formed by stacking a channel plate having a nozzle hole formed therein, a channel plate having a pressure chamber formed therein, and a channel plate having a restrictor formed therein and by bonding the channel plates together by diffusion bonding, wherein the channel plates have substantially the same thickness; a pressure generating source attached to a surface of the ink channel unit and configured to generate pressure to jet ink; and a housing formed by stacking housing plates and by bonding the housing plates together by diffusion bonding and configured to hold the ink channel unit, wherein the housing plates have substantially the same thickness as that of the channel plates.

Another embodiment of the present invention provides an inkjet head that includes an ink channel unit formed by stacking channel plates each having one or more of a nozzle hole, a pressure chamber, and a restrictor formed therein and by bonding together the channel plates by diffusion bonding; a pressure generating source attached to a surface of the ink channel unit and configured to generate pressure to jet ink; and a housing configured to hold the ink channel unit; wherein an ink supply tube configured to supply ink is welded to the ink channel unit; and a through hole configured to house the ink supply tube is formed in the housing.

According to another embodiment of the present invention, a method of producing inkjet heads includes the steps of forming multiple ink channel units by bonding together each one of multiple sets of stacked channel plates by diffusion bonding; forming multiple housings by bonding together each one of multiple sets of stacked housing plates by diffusion bonding; and forming multiple housing units by stacking and bonding together each one of pairs of the ink channel units and the housings by diffusion bonding.

According to still another embodiment of the present invention, a method of producing an inkjet head includes the steps of forming a nozzle unit by stacking a nozzle plate and a channel plate that are made of metal and by bonding together the stacked nozzle plate and the channel plate by diffusion bonding; forming a nozzle hole in the nozzle plate of the formed nozzle unit by pressing or laser processing; and stacking and bonding together the nozzle unit, other channel plates, and housing plates.

DESCRIPTION OF THE PREFERRED EMBODIMENTS

Preferred embodiments of the present invention are described below with reference to the accompanying drawings.

First Embodiment

Figure 1:
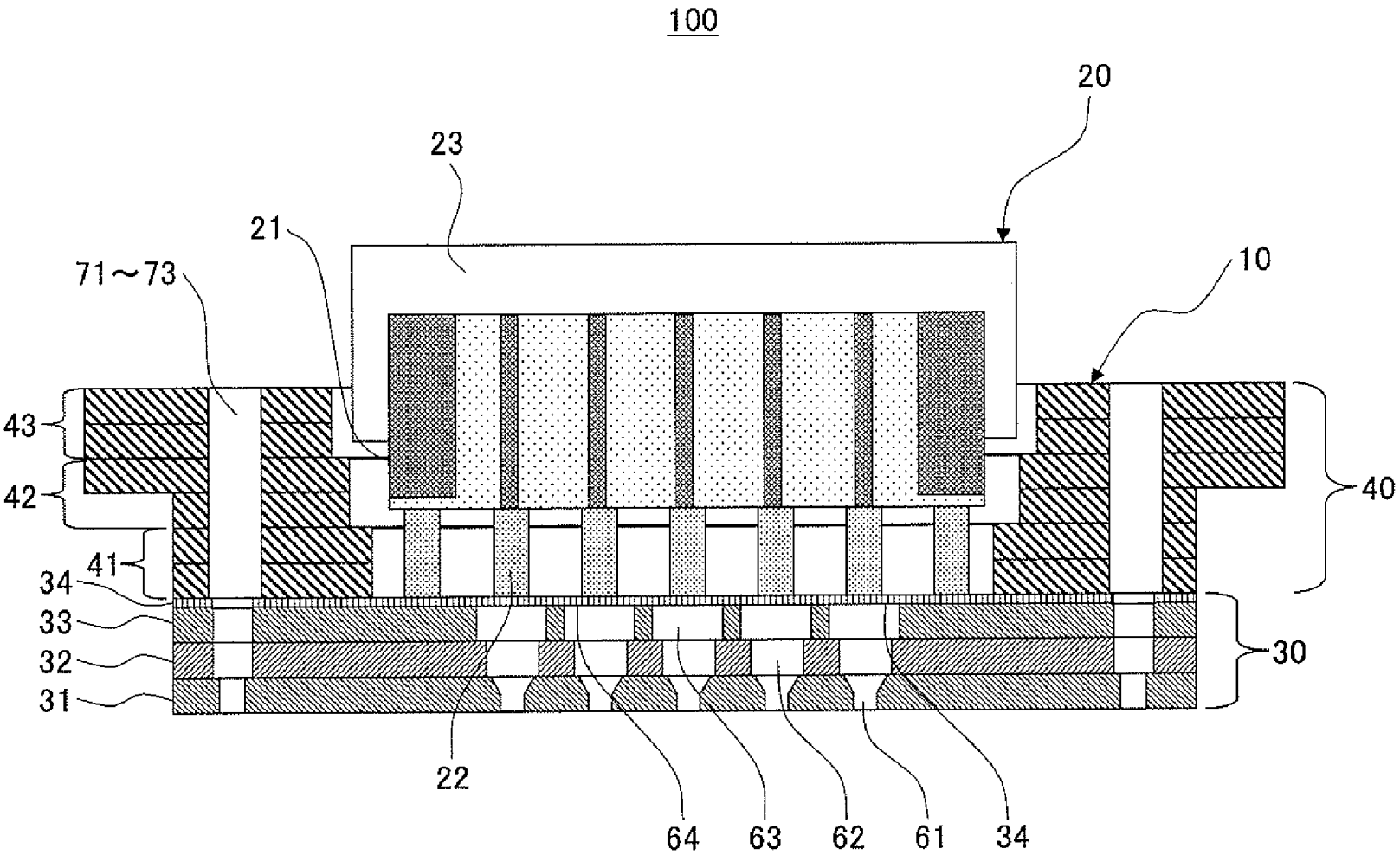
FIG. 1 is a cut-away side view of an exemplary inkjet head according to a first embodiment of the present invention.
Figure 2:
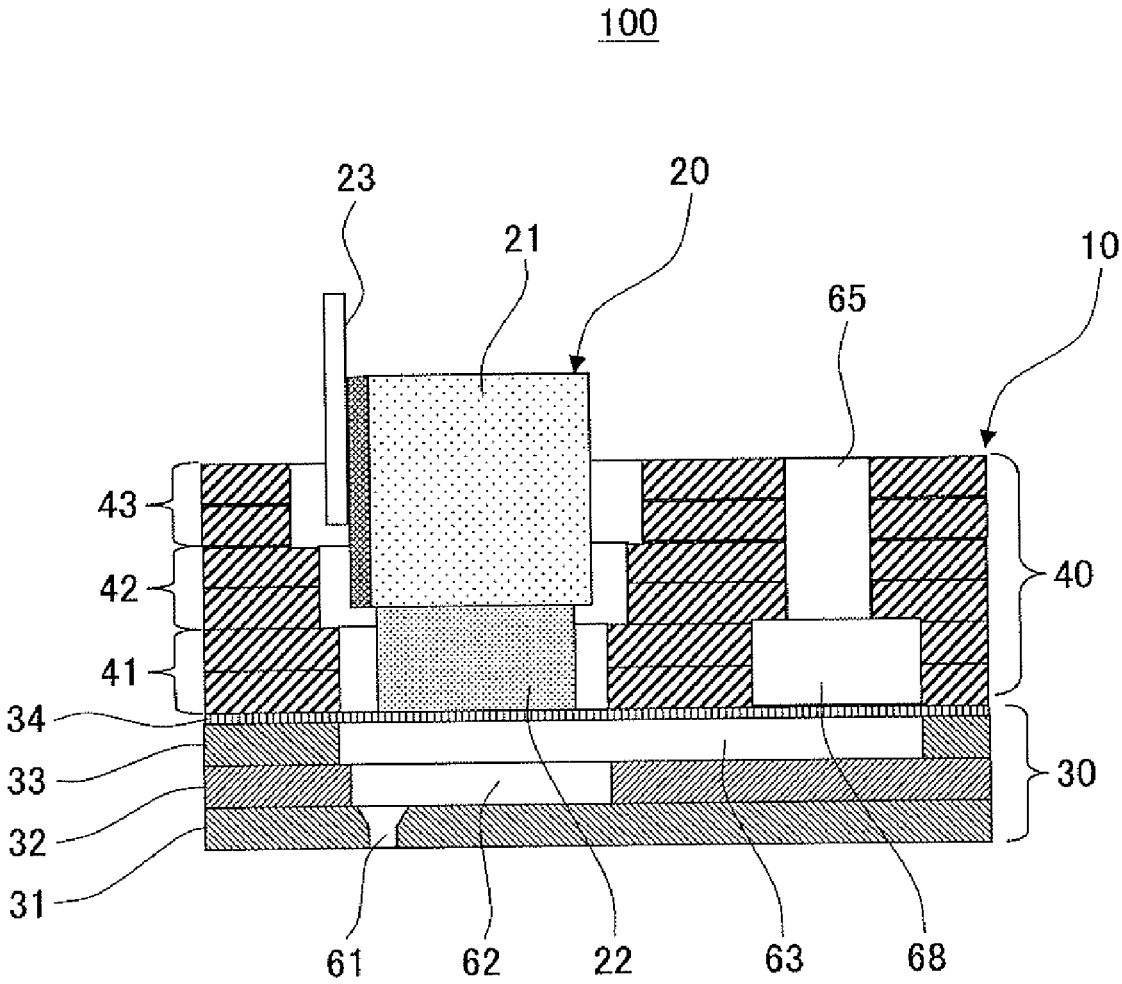
FIG. 2 is a cut-away side view of the exemplary inkjet head shown in FIG. 1 seen from a different angle.
Figure 3A:
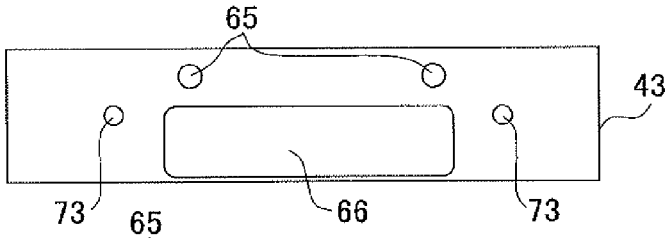
FIGS. 3A through 3G are plan views of exemplary channel plates and exemplary housing plates before being bonded.
Figure 3B:
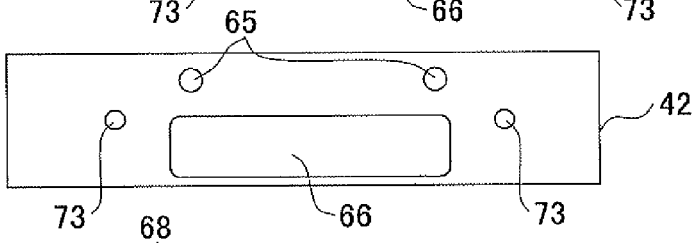
Figure 3C:
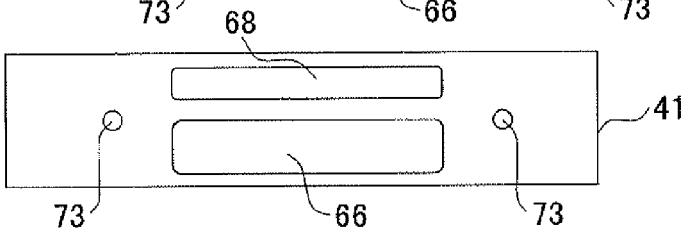
Figure 3D:
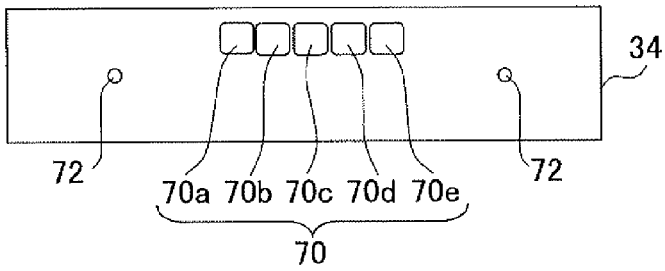
Figure 3E:
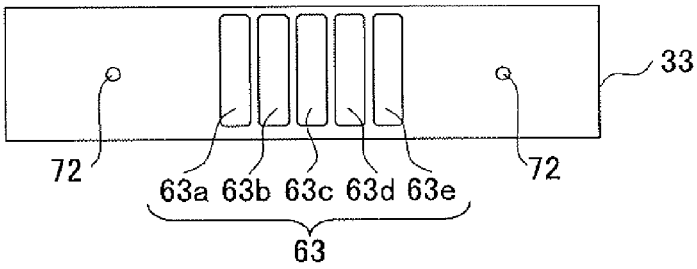
Figure 3F:
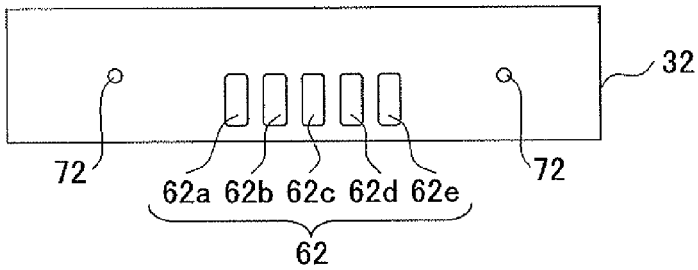
Figure 3G:
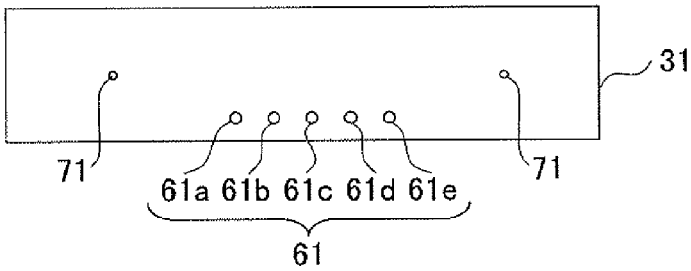

FIG. 1 is a cut-away side view of an exemplary inkjet head according to a first embodiment of the present invention. FIG. 2 is a cut-away side view of the exemplary inkjet head shown in FIG. 1 seen from a different angle. FIGS. 3A through 3G are plan views of exemplary channel plates and housing plates of the exemplary inkjet head. As shown in FIGS. 1 through 3G, an inkjet head 100 according to the first embodiment includes a housing unit 10 for controlling the flow of ink and a driving unit 20 for generating energy to jet the ink. The housing unit 10 and the driving unit 20 are bonded together to form the inkjet head 100.

The housing unit 10 includes an ink channel unit 30 for controlling the flow of ink and a housing 40 for holding the ink channel unit 30.

The driving unit 20 includes a ceramic substrate 21, piezoelectric elements 22 arranged on a side of the ceramic substrate 21 at the same pitch as that of nozzle holes, and an FPC 23 for applying an electrical signal. When an electrical signal is applied by the FPC 23 to the driving unit 20, the piezoelectric elements 22 expand or contract and thereby function as pressure generating sources.

The ink channel unit 30 is formed by stacking multiple channel plates made of metal and by bonding the stacked channel plates together by diffusion bonding. The ink channel unit 30 according to the first embodiment is made up of four channel plates: a nozzle plate 31 in which nozzle holes 61 (61*a* through 61*e*) used as nozzles for jetting ink are formed; a chamber plate 32 in which pressure chambers 62 (62*a* through 62*e*) for containing ink are formed; a restrictor plate 33 in which restrictors 63 (63*a* through 63*e*) that function as fluid resistors are formed; and a diaphragm plate 34 in which communicating holes 70 (70*a* through 70*e*) are formed.

Areas on the diaphragm plate 34 that are brought into contact with the piezoelectric elements 22 correspond to the positions of the restrictors 63 and function as vibrating parts 64 that vibrate up and down according to the expansion and contraction of the piezoelectric elements 22. The vibration of the vibrating parts 64 pressurize ink supplied into the restrictors 63 and thereby jet the ink from the nozzle holes 61.

The channel plates 31-34 are made of metal (for example, chemical resistant stainless steel). The channel plates other than the diaphragm plate 34 have substantially the same thickness. In the chamber plate 32, the restrictor plate 33, and the diaphragm plate 34, ink channels are formed by etching. The nozzle holes 61 in the nozzle plate 31 are formed by pressing or by laser processing.

The restrictor plate 33 and the chamber plate 32 may be integrated and formed as a monolithic structure. Forming the restrictor plate 33 and the chamber plate 32 as a monolithic structure reduces the number of channel plates and the number of bonding steps and therefore improves the production efficiency.

In the diaphragm plate 34, the communicating holes 70 (70*a* through 70*e*) leading to the restrictors 63 are formed. In the nozzle plate 31, positioning holes 71 are formed. Also, in each of the channel plates 32 through 34, positioning holes 72 are formed. The positioning holes 72 are larger than positioning holes 71. If the channel plates 32 through 34 are misaligned when they are bonded together and, as a result, the positioning holes 72 are misaligned, the practical sizes of the positioning holes 72 may become smaller than the actual sizes. The positioning holes 72 are made larger than the positioning holes 71 to cope with this problem. In other words, when the channel plates 31 through 34 are stacked, the positioning holes 71 having a smaller size are used as reference holes.

The housing 40 is formed by stacking housing plates 41 though 43 having substantially the same thickness as that of the channel plates 31 through 33 and by bonding the stacked housing plates 41 though 43 together by diffusion bonding. In each of the housing plates 41 through 43, a through hole 66 and positioning holes 73 are formed.

The size of the positioning holes 73 is made larger than the sizes of the positioning holes 71 and 72 to cope with the above mentioned problem associated with misalignment of plates. In this embodiment, two of each of the housing plates 41 through 43 (six plates in total) are stacked to form the housing 40. When the channel plates 31 through 34 are stacked, the nozzle holes 61 (61*a* through 61*e*), the pressure chambers 62 (62*a* through 62*e*), the restrictors 63 (63*a* through 63*e*), and the communicating holes 70 (70*a* through 70*e*) are connected.

The housing plates 41 are positioned at the bottom of the housing 40 and in contact with the diaphragm plate 34. In each of the housing plates 41, the through hole 66 shaped like a rectangle for inserting the driving unit 20 and a manifold 68 shaped like a thin rectangle are formed.

In each of the housing plates 42 and 43, a through hole 66 and ink supply holes 65 instead of the manifold 68 are formed.

The aperture area (or the length and width dimensions) of the through hole 66 of the housing plates 42 is larger than that of the housing plates 41 and the aperture area of the through hole 66 of the housing plates 43 is larger than that of the housing plates 42. Thus, the through holes 66 are configured so as not to interfere with the driving unit 20 even when the housing plates 41 through 43 are misaligned.

An exemplary method of producing the housing unit 10 is described below. In this embodiment, the housing plates 41 through 43 and the channel plates 31 through 34 are all bonded by diffusion bonding. In diffusion bonding, metal plates are bonded together by heating them to a temperature of 1000° C. or higher in a vacuum and by pressing them together. Thus, diffusion bonding makes it possible to bond metal plates together without using an adhesive. Before diffusion bonding, the bonding surfaces of metal plates to be bonded must be cleaned. Also, the difference in thickness of the housing plates 41 through 43 and the channel plates 31 through 33 is preferably within plus or minus 1 μm.

In this embodiment, the housing unit 10 is formed through steps 1-5 described below.

(Step 1) The nozzle plate 31 and the chamber plate 32 are stacked and bonded together by diffusion bonding to form a unit A1 (not shown).

(Step 2) The restrictor plate 33 is bonded onto the upper surface of the unit A1 by diffusion bonding to form a unit B1 (not shown).

(Step 3) The diaphragm plate 34 is bonded onto the upper surface of the unit E1 by diffusion bonding to form the ink channel unit 30.

(Step 4) The housing plates 41 through 43 are stacked and bonded together by diffusion bonding to form the housing 40.

Figure 4:
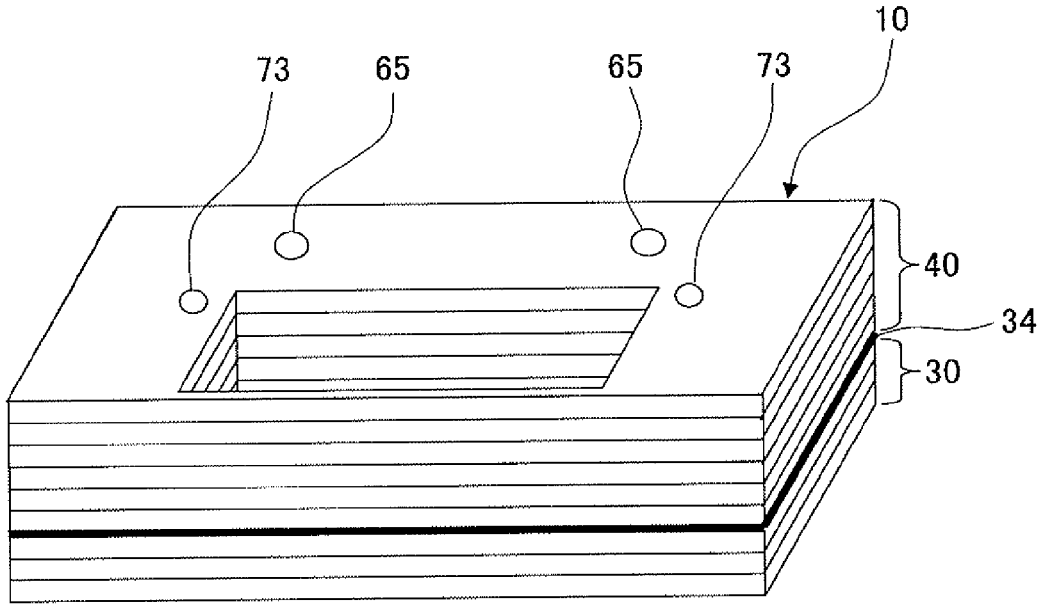
FIG. 4 is a perspective view of a housing unit 10 according to the first embodiment.

(Step 5) The ink channel unit 30 and the housing 40 are bonded together by diffusion bonding to form the housing unit 10 as shown in FIG. 4.

As described above, the housing unit 10 is formed by diffusion bonding steps 1 through 5.

In steps 1 through 5 described above, the ink channel unit 30 and the housing 40 are fabricated separately. However, the order of bonding the channel plates 31 through 34 and the housing plates 41 through 43 is not limited to the order mentioned above. For example, the diaphragm plate 34 and the housing plate 41 may be bonded first before bonding other plates. In this case, a frame may be provided for the housing plate 41 so that the housing plate 41 can be firmly pressed onto the diaphragm plate 34. The subsequent steps may also be changed according to the structure of ink channels.

Figure 5:
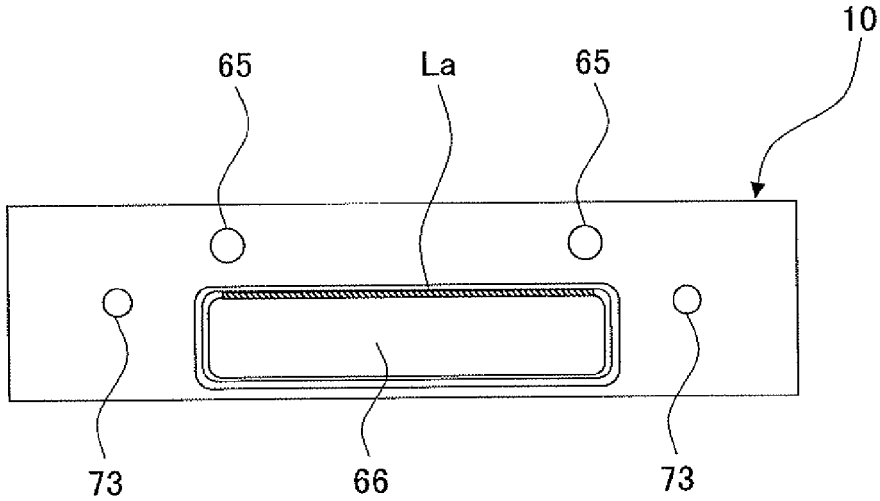
FIG. 5 is a plan view of the housing unit 10 according to the first embodiment.

After step 5, an unbonded area, which is a weakly bonded area between the housing 40 and the diaphragm plate 34, is sealed by laser welding. FIG. 5 is a plan view of the housing unit 10. In FIG. 5, the shaded area indicates an unbonded area La to be sealed by laser welding. The unbonded area La is located between the surface of the diaphragm plate 34 and the edge of the through hole 66 of the housing plate 41. Since the unbonded area La is not pressed enough, the bonding reliability becomes low. The unbonded area La is therefore sealed by laser welding to prevent leakage of ink.

Figure 6:
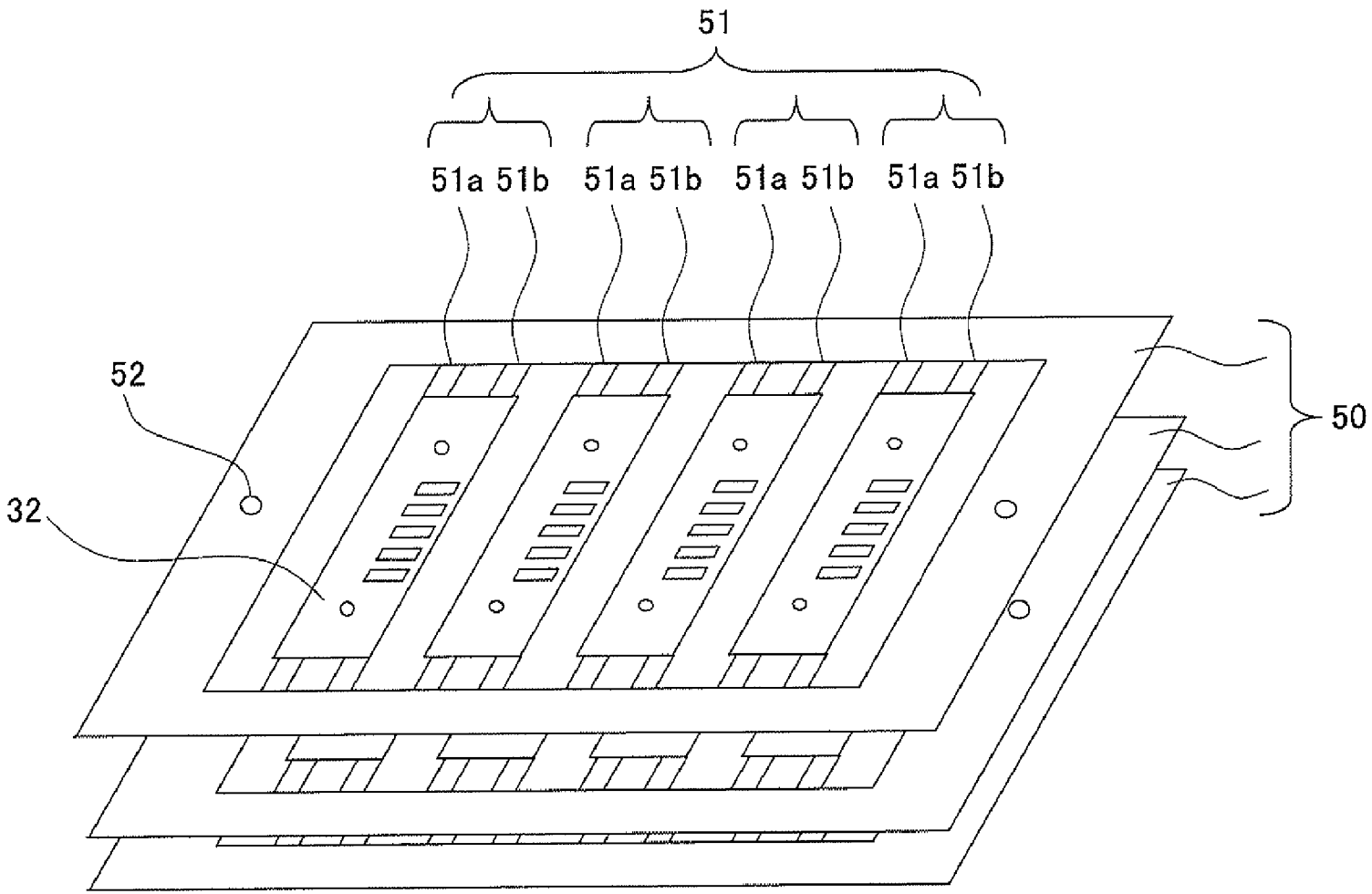
FIG. 6 is a drawing illustrating multiple sets of channel plates and housing plates before being bonded by diffusion bonding.

Next, an exemplary method of forming multiple housing units 10 in one process is described. FIG. 6 is a drawing illustrating the ink channel plates 31 through 34 and the housing plates 41 through 43 before being bonded by diffusion bonding. As shown in FIG. 6, multiple sets of the channel plates 31 through 34 and the housing plates 41 through 43 are supported by support parts 51 each consisting of parallel ribs 51*a* and 51*b* and thereby attached to base plates 50. These plates are formed by etching. In this embodiment, bonding steps are performed with the multiple sets of the channel plates 31 through 34 and the housing plates 41 through 43 attached to the base plates 50. The base plates 50 are aligned by using base positioning holes 52 formed in the frame of each of the base plates 50.

Figure 7A:
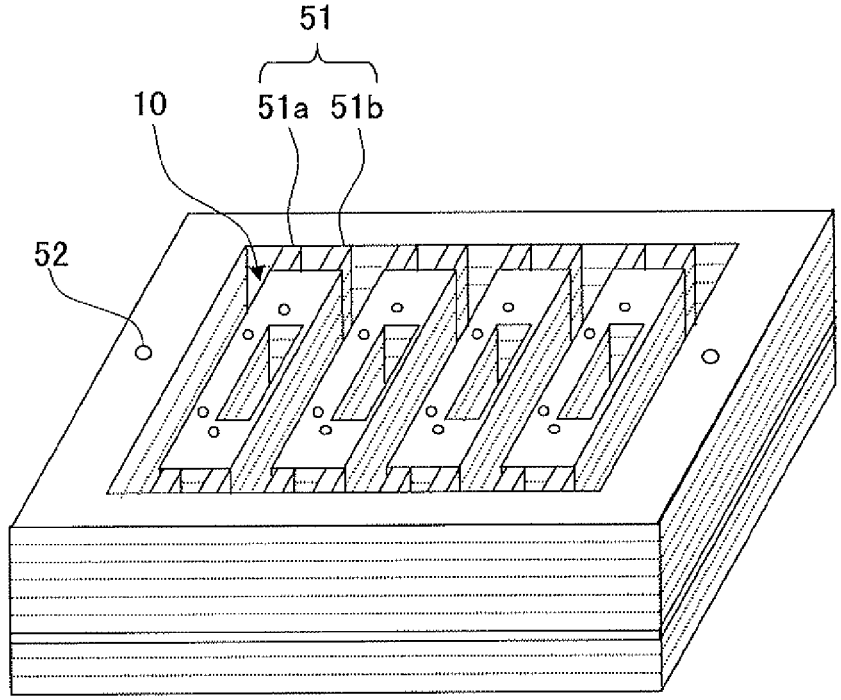
FIGS. 7A and 7B are drawings used to describe an exemplary process of producing multiple housing units 10 by stacking multiple sets of channel plates and housing plates that are supported by ribs 51*a* and 51*b* and thereby attached to base plates 50.

In this exemplary method, as shown in FIG. 7A, multiple housing units 10 (for example, four of them) are formed in the frame of the base plates 30 by just performing the bonding steps once. The number of plates attached to each of the base plates 50 can be changed according to the size of a diffusion bonding apparatus.

Figure 7B:
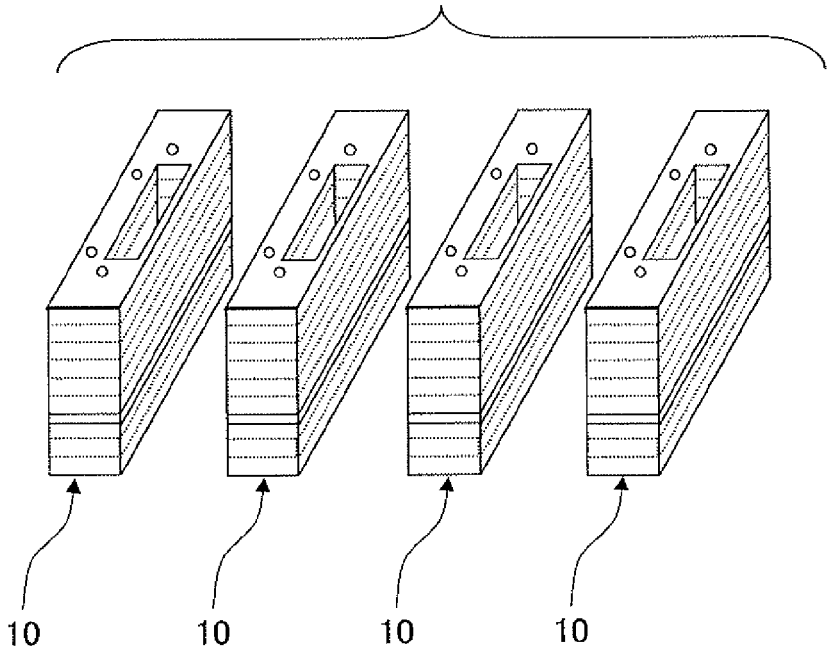

After forming multiple housing units 10 by diffusion bonding, the ribs 51*a* and 51*b* are cut by a cutting device such as a wire cutter to separate the housing units 10 from the base plates 50 as shown in FIG. 7B. Thus, the above exemplary method makes it possible to form multiple housing units 10 in one process.

Figure 8:
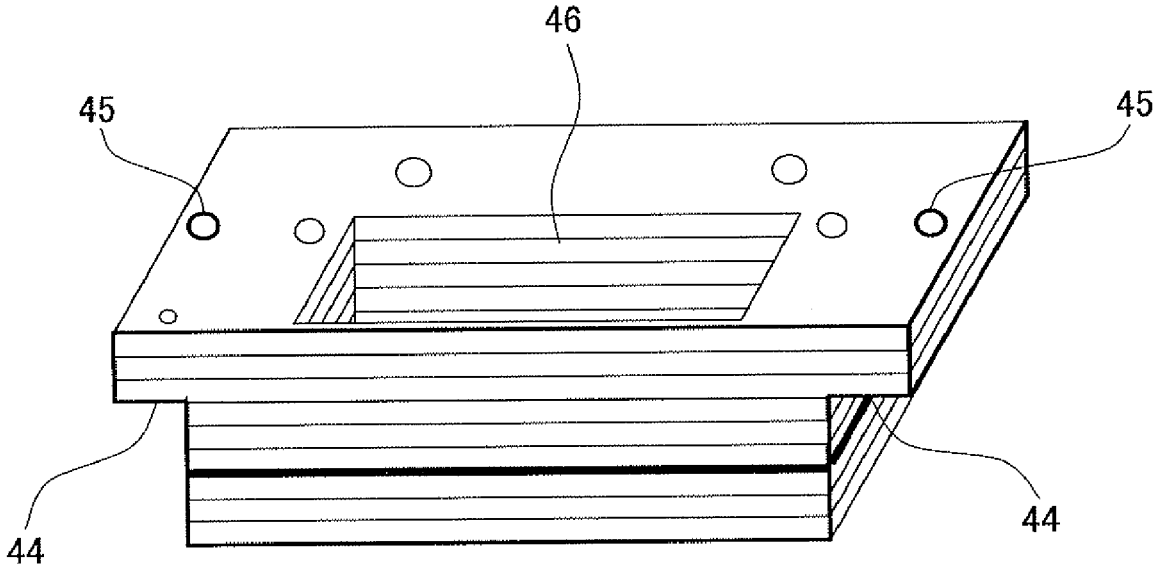
FIG. 8 is a perspective view of the housing unit 10 where head mounting shoulders 44 are formed by machining.

After forming the housing unit 10, as shown in FIG. 8, a head mounting shoulder 44 is formed by machining and a head mounting hole 45 is formed by laser processing at each end of the housing unit 10.

Also, it is possible to form the head mounting shoulder 44 before bonding the channel plates 31 through 34 and the housing plates 41 through 43. However, in this case, the outer shapes or areas of the plates become inconsistent, and this inconsistency makes it difficult to align the plates and therefore increases the bonding steps.

In the next step, the driving unit 20 is bonded with an adhesive to the housing unit 10 prepared as described above and the inkjet head 100 is completed.

In the inkjet head 100 produced as described above, no adhesive is used in the part where ink flows and therefore even an ink that corrodes adhesives may be used. The produced inkjet head 100 may have different characteristics from those of a conventional inkjet head produced by using an adhesive. Therefore, it is preferable to determine a discharge waveform and a voltage that are different from such a conventional inkjet head for the inkjet head 100. In this embodiment, the channel plates 31 through 34 and the housing plates 41 through 43 are made of the same material and therefore have a substantially uniform thermal expansion coefficient. This gives excellent heat resistance to the inkjet head 100.

Second Embodiment

Figure 9A:
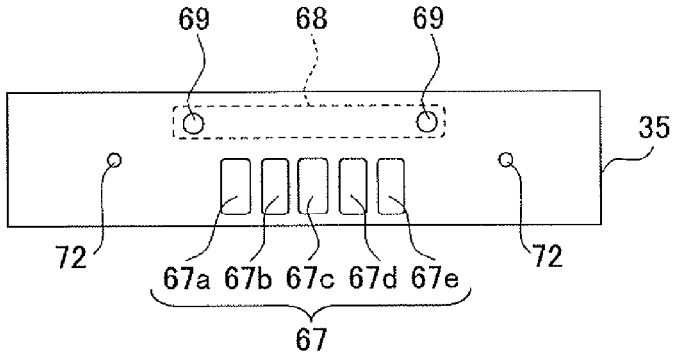
FIGS. 9A through 9E are plan views of exemplary channel plates and an exemplary support plate, which are to be bonded together, of an exemplary inkjet head according to a second embodiment of the present invention.
Figure 9B:
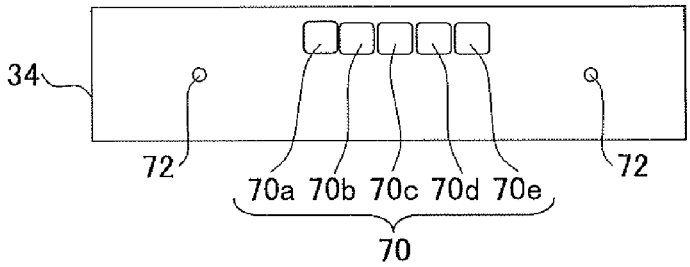
Figure 9C:
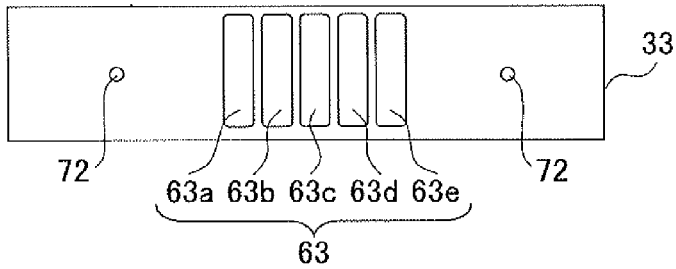
Figure 9D:
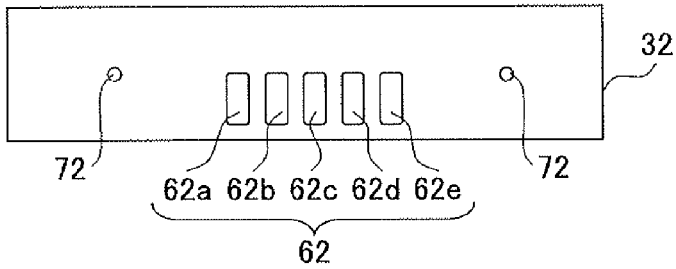
Figure 9E:
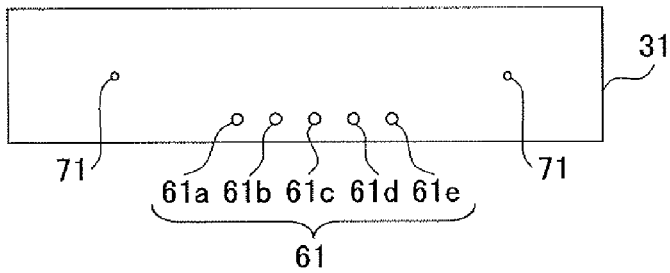

FIGS. 9R through 9E are plan views of channel plates 31 through 34 and a support plate 35 according to a second embodiment of the present invention. In FIGS. 9A through 9E, the same reference numbers are used for parts corresponding to those shown in FIG. 3, and descriptions of those parts are omitted. As shown in FIGS. 9A through 9E, in the second embodiment, the support plate 35 is additionally bonded onto the channel plates 31 through 34 to form an ink channel unit 30.

In the support plate 35, frame parts 67 (67*a* through 67*e*) for inserting piezoelectric elements 22 are formed by full etching. On the under surface of the support plate 35, a recess (shown by a broken line in FIG. 9A) used as a manifold 68 is formed by half etching. Also, at each end of the manifold 68, an ink supply hole 69 for supplying ink is formed.

In the second embodiment, plates are bonded together through steps 1*a* through 3*a* described below.

(Step 1*a*) The nozzle plate 31 and the chamber plate 32 are bonded together by diffusion bonding to form a unit A2 (not shown).

(Step 2*a*) The support plate 35 and the diaphragm plate 34 are bonded together by diffusion bonding to form a unit B2 (not shown).

Figure 10:
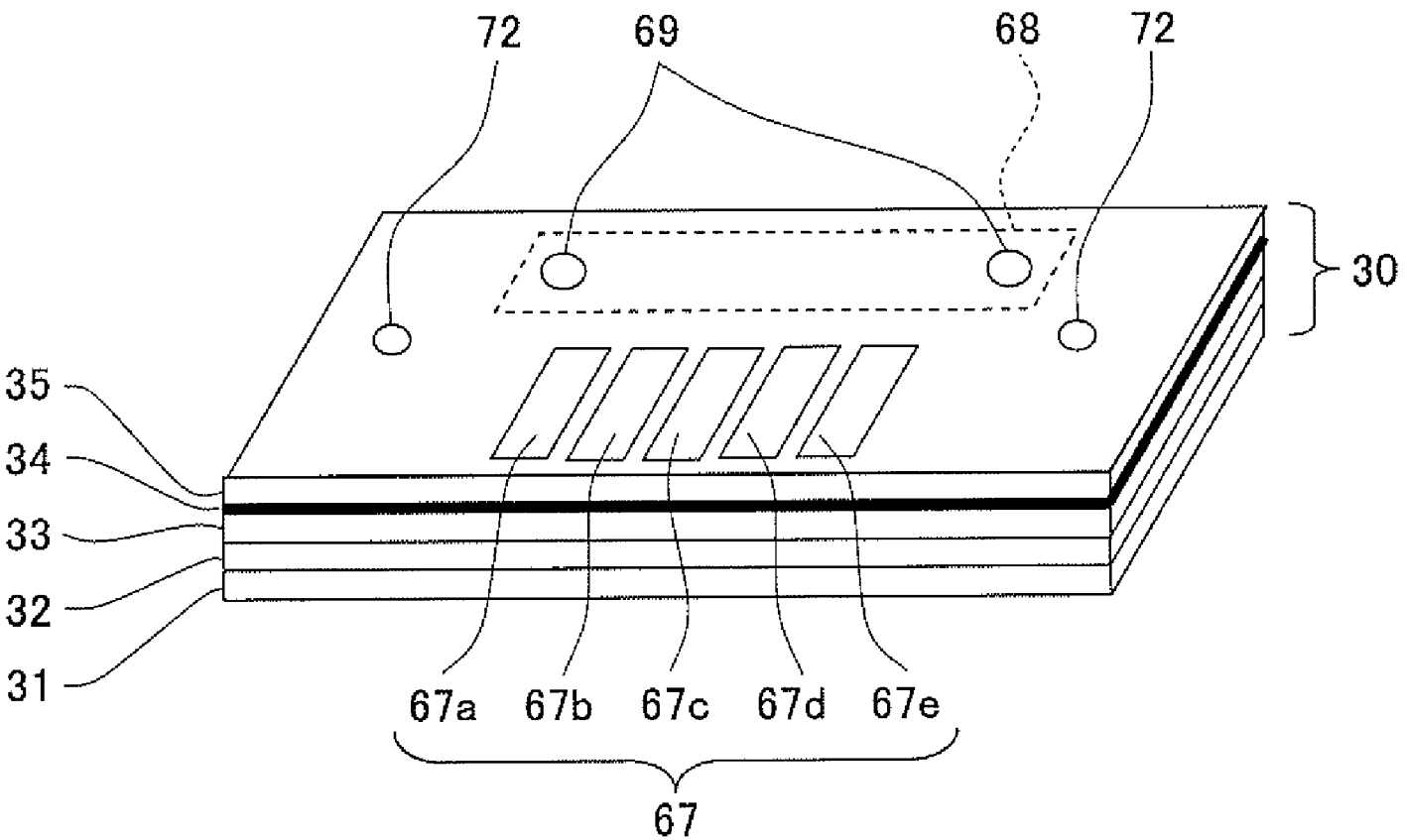
FIG. 10 is a drawing used to describe a process of producing an ink channel unit 30 according to the second embodiment.

(Step 3*a*) As shown in FIG. 10, the unit A2, the restrictor plate 33, and the unit B2 are bonded together by diffusion bonding to form the ink channel unit 30. As described above, in the second embodiment, the ink channel unit 30 is formed entirely by diffusion bonding through steps 1*a* through 3*a*. Unlike in the first embodiment, no unbonded area (see FIG. 5) is left in the ink channel unit 30.

Figure 11:
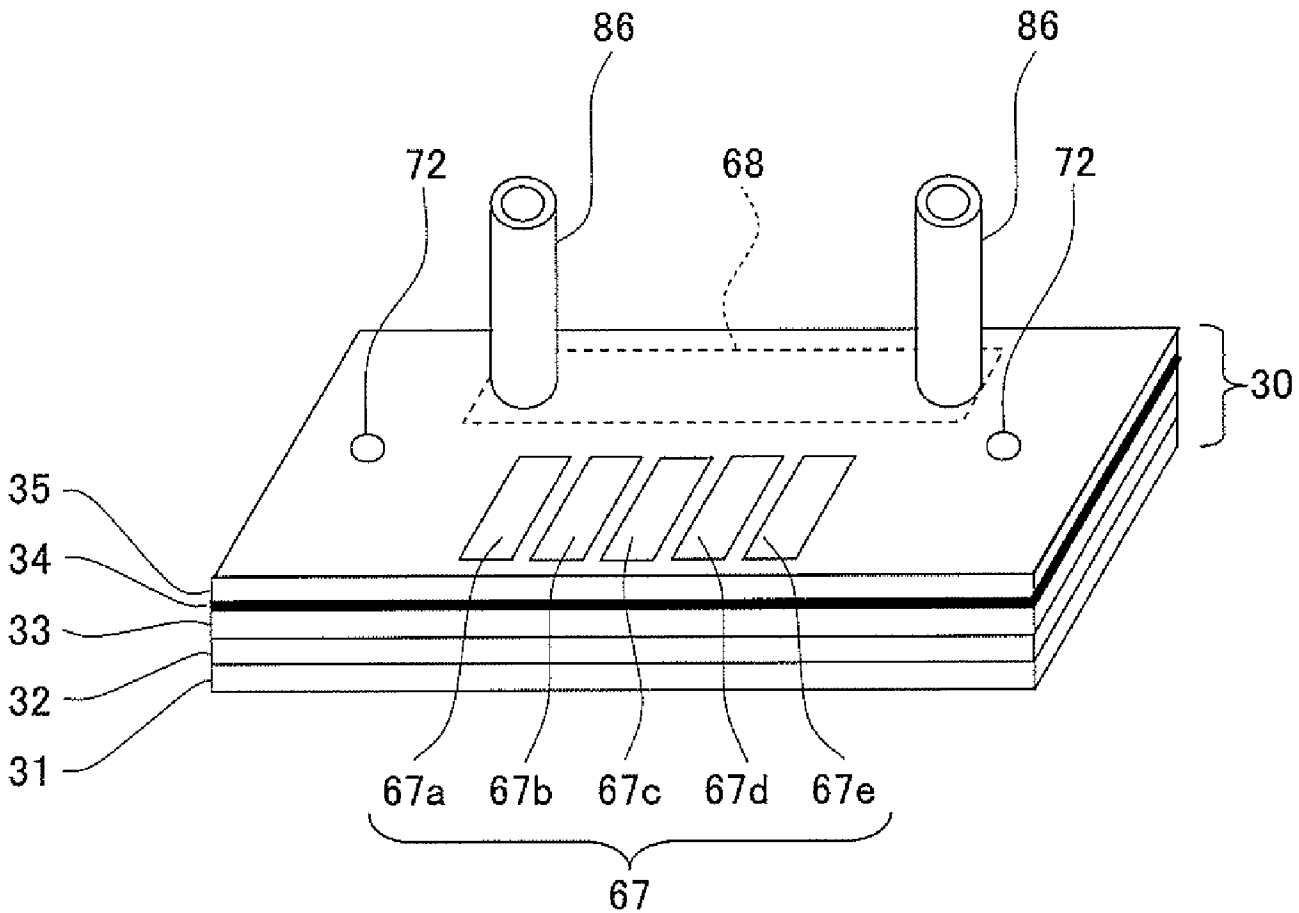
FIG. 11 is a perspective view of the ink channel unit 30 onto which ink supply tubes 86 are welded.

In the next step, as shown in FIG. 11, two ink supply tubes 86 are welded onto the upper surface of the ink channel unit 30. The ink supply tubes 86 are made of the same material (for example, chemical resistant stainless steel) as that of the ink channel unit 30.

In the next step, a housing 40 is bonded with an adhesive to the ink channel unit 30. The housing 40 is formed by machining or molding. In this embodiment, the housing 40 is made of resin and a room temperature setting adhesive is used.

Figure 12:
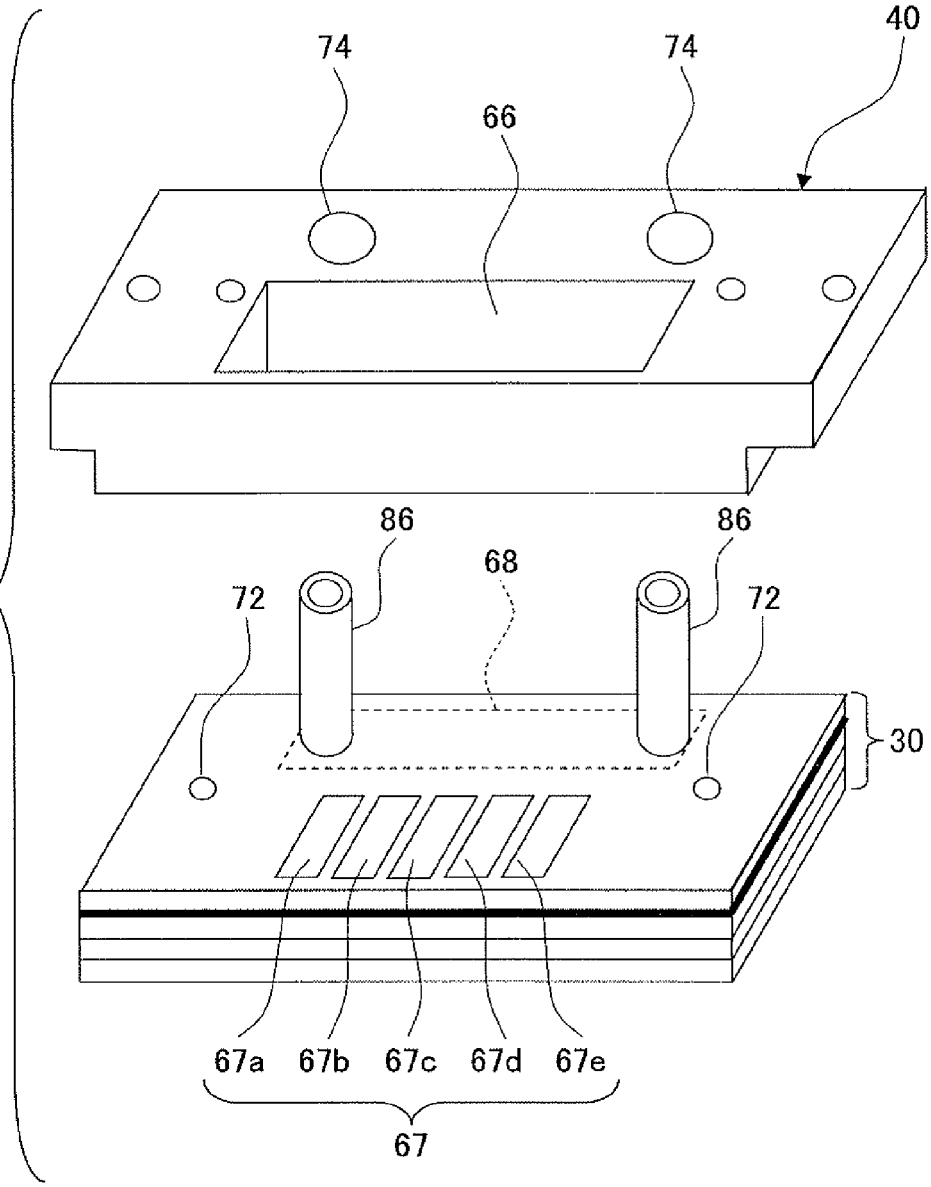
FIG. 12 is a drawing used to describe a process of mounting the housing 40 onto the ink channel unit 30.

As shown in FIG. 12, a through hole 66 for inserting a driving unit 20 and ink supply tube inserting holes 74 for inserting the ink supply tubes 86 are formed in the housing 40.

Figure 13:
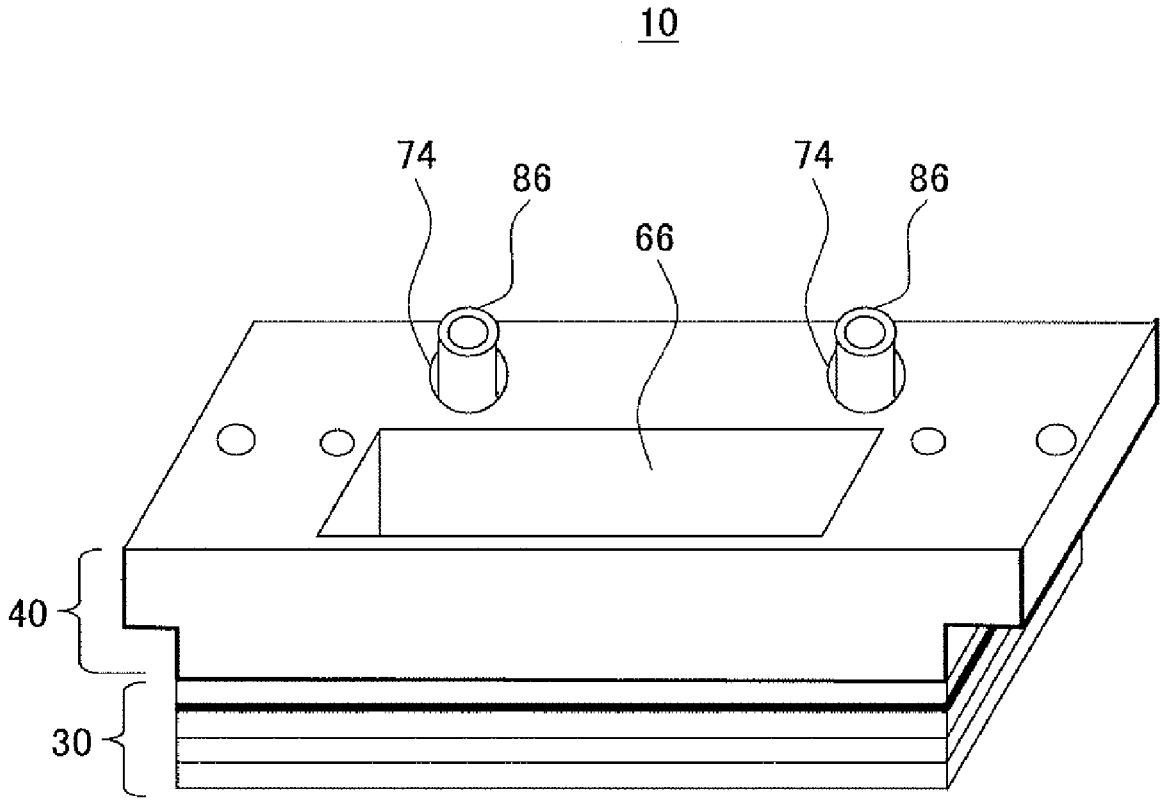
FIG. 13 is a perspective view of the ink channel unit 30 bonded to the housing 40.

As shown in FIG. 13, the ink supply tubes 86 are passed through and fixed to the ink supply tube inserting holes 74.

As described above, in the second embodiment, the housing 40 is bonded with an adhesive to the ink channel unit 30. However, this causes no problem since no adhesive is used in the part where ink flows. Also, bonding the housing 40 and the ink channel unit 30 with an adhesive makes it possible to reduce time-consuming diffusion-bonding steps and thereby to improve the production efficiency.

Third Embodiment

Figure 14:
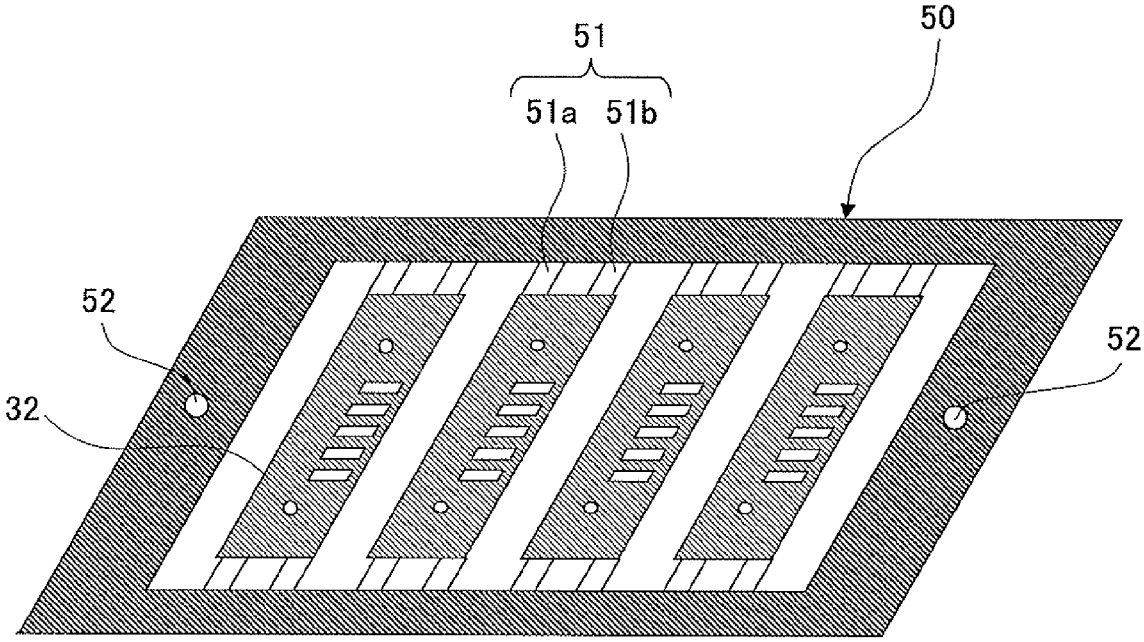
FIG. 14 is a drawing used to describe an exemplary grinding process according to a third embodiment of the present invention.

FIG. 14 is a drawing used to describe an exemplary grinding process according to a third embodiment of the present invention. As shown in FIG. 14, multiple sets of the channel plates 31 through 34 and the housing plates 41 through 43 are supported by the support parts 51 each consisting of the ribs 51*a* and 51*b* and thereby attached to the base plates 50. In the third embodiment, these plates are formed by pressing.

In this embodiment, a pressing method that can form plates and holes more accurately than etching methods is used. While a pressing method provides higher accuracy, it may generate burrs at the edges of plates and holes and such burrs may cause bonding defects.

To cope with this problem, in this embodiment, entire surfaces of the plates (for example, shaded areas in FIG. 14) formed by pressing are ground to remove the burrs and to make the thickness of the plates uniform. In this case, to make it easier to achieve a uniform thickness, the number of sets of the channel plates 31 through 34 and the housing plates 41 through 43 is preferably between about two and four.

Fourth Embodiment

Figure 15A:
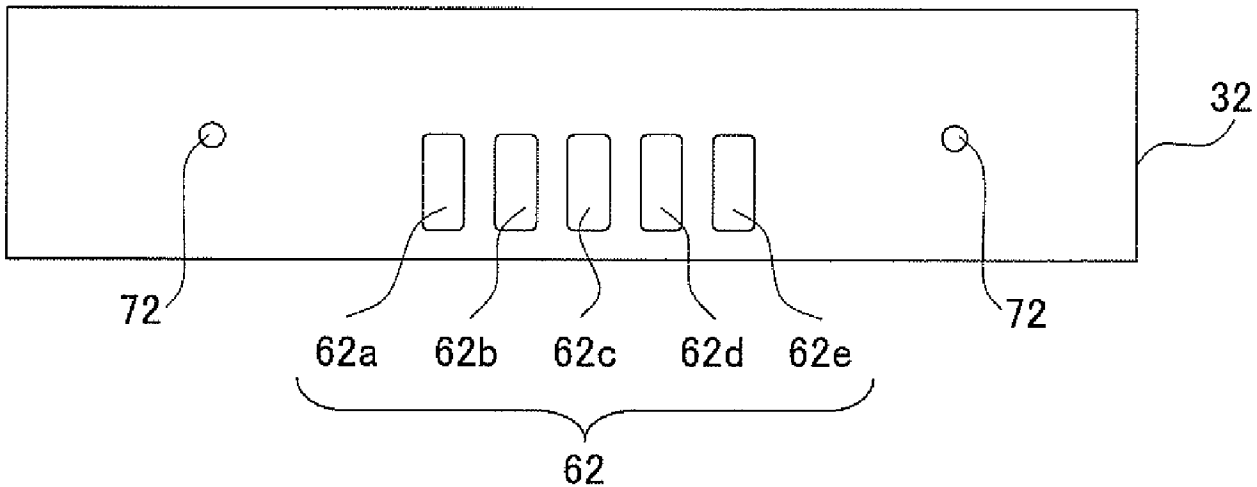
FIGS. 15A and 15B are plan views of a nozzle plate 31 and a chamber plate 32 according to a fourth embodiment of the present invention.
Figure 15B:
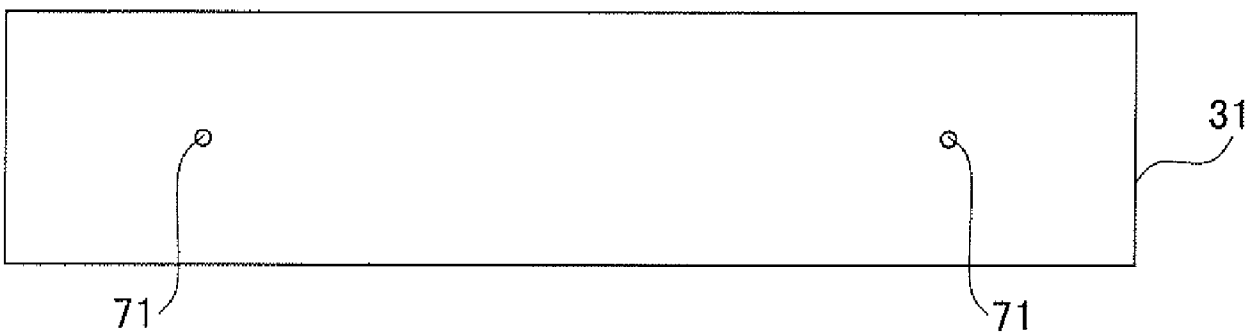
Figure 16A:
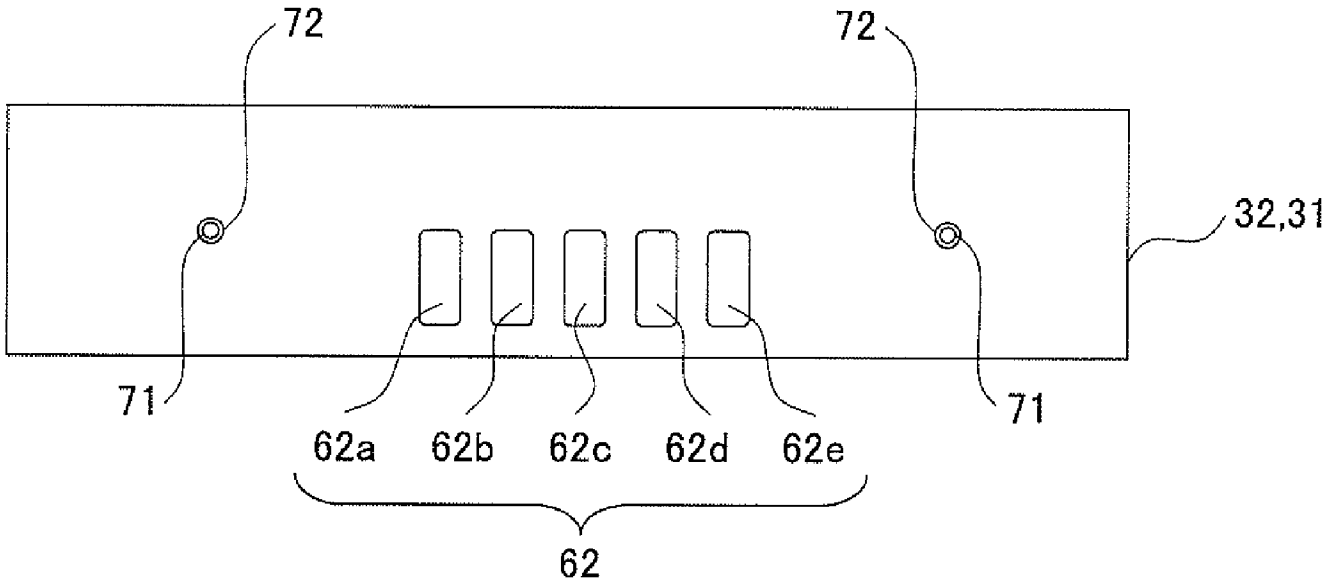
FIGS. 16A and 16B are drawings illustrating the nozzle plate 31 and the chamber plate 32 that are bonded together.
Figure 16B:
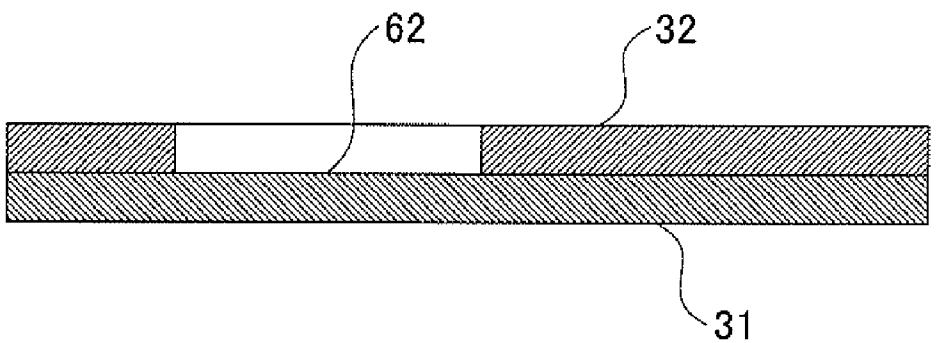
Figure 17A:
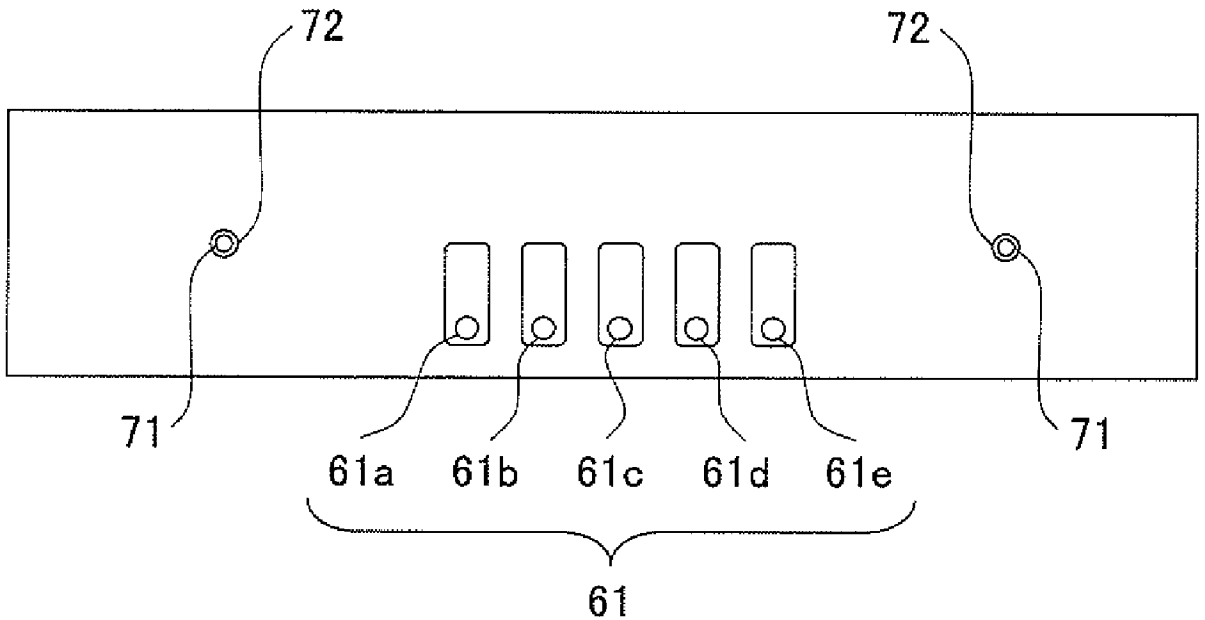
FIGS. 17A and 17B are drawings illustrating the nozzle plate 31 and the chamber plate 32 bonded together in which nozzle plate 31 nozzle holes 61 are formed.
Figure 17B:
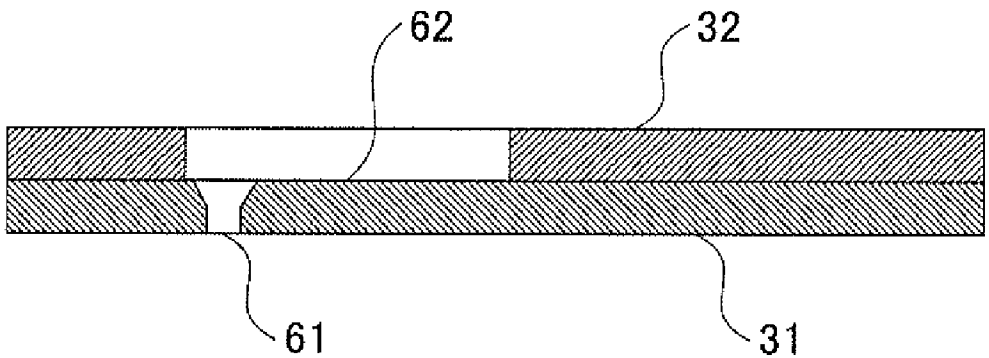

FIGS. 15A and 15B are plan views of the nozzle plate 31 and the chamber plate 32 according to a fourth embodiment of the present invention. FIGS. 16A and 16B are drawings illustrating the nozzle plate 31 and the chamber plate 32 that are bonded together. FIGS. 17A and 17B are drawings illustrating the nozzle plate 31 and the chamber plate 32 bonded together in which nozzle plate 31 the nozzle holes 61 are formed.

In step 1 according to the fourth embodiment, as shown in FIGS. 15A and 15B, the pressure chambers 62 (62*a* through 62*e*) and the positioning holes 72 are formed in the chamber plate 32.

In step 2, as shown in FIGS. 16A and 16B, the nozzle plate 31 without the nozzle holes 61 and the chamber plate 32 are stacked and bonded together by diffusion bonding.

In step 3, as shown in FIGS. 17A and 17B, the nozzle holes 61 are formed in the nozzle plate 31 by pressing or laser processing.

When the nozzle holes 61 are formed by pressing, the nozzle plate 31 is pressed from the upper side, in other words, through the pressure chambers 62. This method makes it possible to accurately align the positions of the pressure chambers 62 and the nozzle holes 61.

According to an embodiment of the present invention, a housing is formed by stacking housing plates having substantially the same thickness as that of channel plates. This method makes it possible to produce multiple housings with substantially the same thickness and thereby makes it possible to produce multiple inkjet heads by performing bonding steps only once. Also, compared with an integral molding method, the above method makes it possible to produce a housing and an ink channel unit having a smaller difference in thermal expansion coefficients by using diffusion bonding.

According to another embodiment of the present invention, positioning holes in a nozzle plate are made smaller than those in other channel plates and housing plates. This configuration improves the accuracy in aligning and diffusion-bonding the plates based on the positioning holes using positioning pins and prevents the bonded plates from interfering with the positioning pins even if the positioning holes are slightly misaligned.

Another embodiment of the present invention makes it possible to apply pressure from both sides of stacked channel plates and housing plates when bonding the stacked plates by diffusion bonding.

According to another embodiment of the present invention, head mounting shoulders for mounting the produced inkjet head are formed by machining after bonding the plates by diffusion bonding. This method makes it possible to apply pressure even to the parts to be formed as the head mounting shoulders and thereby improves the bonding strength of the housing unit.

According to another embodiment of the present invention, holes in housing plates are formed in different sizes so that the aperture areas of, for example, ink supply paths and a through hole for inserting pressure generating sources become larger or smaller in the upward or downward direction. This configuration makes it possible to efficiently release air bubbles and to minimize crosstalk by reducing the aperture areas of communicating holes in the diaphragm plate.

According to another embodiment of the present invention, multiple channel plates and housing plates are cut out of a single sheet of stainless steel and processed by etching. This method makes it possible to create channel plates and housing plates with substantially the same thickness and thereby to produce ink channel units and housings with substantially uniform thicknesses. This, in turn, improves productivity.

According to another embodiment of the present invention, an ink channel unit is produced by diffusion bonding and ink supply tubes are welded onto the ink channel unit. This method makes it possible to produce an inkjet head through fewer diffusion bonding steps and without using an adhesive and thereby to improve the productivity. Also, the ink supply tubes make it easier to supply ink.

Further, with the ink supply tubes, the housing is not exposed to ink and therefore can be produced by machining or molding a metal material at low costs.

According to another embodiment of the present invention, an ink channel unit and a housing are bonded together by diffusion bonding and an unbonded area is later sealed by welding. This method makes it possible to seal areas where sufficient pressing force cannot be applied and thereby to prevent leakage of ink into a space where pressure generating sources are housed. This, in turn, improves flexibility in designing the shape of an ink channel unit.

According to another embodiment of the present invention, channel plates are formed by pressing a stainless steel plate. After the pressing process, burrs are removed and distortion is corrected by grinding the surfaces of the channel plates. This method improves the bonding reliability of the ink channel unit produced by diffusion-bonding channel plates formed by pressing.

According to another embodiment of the present invention, multiple sets of channel plates are stacked and bonded together by diffusion bonding at once to produce multiple ink channel units; multiple sets of housing plates are stacked and bonded together by diffusion bonding at once to produce multiple housings; and pairs of the multiple ink channel units and the multiple housings are bonded together at once by diffusion bonding. This method makes it possible to increase the number of inkjet heads produced in one process and thereby to improve the productivity.

According to still another embodiment of the present invention, a nozzle unit is formed by bonding multiple metal plates and a channel plate together by diffusion bonding and nozzle holes are formed in the nozzle unit by pressing or laser processing. This method makes it possible to accurately align the positions of nozzle holes and ink channels and thereby to prevent degradation of ink discharging performance caused by misalignment.

The present invention is not limited to the specifically disclosed embodiments, and variations and modifications may be made without departing from the scope of the present invention.

The present application is based on Japanese Priority Application No. 2006-042602, filed on Feb. 20, 2006, the entire contents of which are hereby incorporated herein by reference.

What is claimed is:

1. An inkjet head, comprising:

an ink channel unit formed by stacking a channel plate having a nozzle hole formed therein, a channel plate having a pressure chamber formed therein, and a channel plate having a restrictor formed therein and by bonding the channel plates together by diffusion bonding, wherein the channel plates have substantially the same thickness;

a pressure generating source attached to a surface of the ink channel unit and configured to generate pressure to jet ink; and a housing formed by stacking housing plates and by bonding the housing plates together by diffusion bonding and configured to hold the ink channel unit, wherein the housing plates have substantially the same thickness as that of the channel plates.

2. The inkjet head as claimed in claim 1, wherein each of the channel plates and the housing plates have a positioning hole formed therein and the positioning hole formed in the channel plate having the nozzle hole has a smallest diameter.

3. The inkjet head as claimed in claim 2, wherein a head mounting shoulder is formed by machining at each end of the housing.

4. The inkjet head as claimed in claim 1, wherein a through hole is formed in each of the housing plates and a size of the through hole in any one of the housing plates is larger or smaller than the size of the through hole in an adjacent one of the housing plates.

5. The inkjet head as claimed in claim 1, wherein the channel plates and the housing plates are stainless steel plates in each of which an ink channel where ink flows is formed by etching.

6. An inkjet head, comprising:

an ink channel unit formed by stacking channel plates each having one or more of a nozzle hole, a pressure chamber, and a restrictor formed therein and by bonding together the channel plates by diffusion bonding;

a pressure generating source attached to a surface of the ink channel unit and configured to generate pressure to jet ink; and a housing formed by stacking housing plates and by bonding the housing plates together by diffusion bonding and configured to hold the ink channel unit, wherein an ink supply tube configured to supply ink is welded to the ink channel unit, a through hole configured to house the ink supply tube is formed in the housing, and the channel plates and the housing plates have substantially the same thickness.

7. The inkjet head as claimed in claim 6, wherein the housing is made of metal and produced by machining or molding.

8. The inkjet head as claimed in claim 1, wherein an unbonded area, which is a weakly bonded area between the ink channel unit and the housing that are bonded together by diffusion bonding, is sealed by welding.

9. The inkjet head as claimed in claim 1, wherein each of the channel plates is formed by pressing a stainless steel plate and by grinding surfaces of the pressed stainless steel plate until burrs and distortion generated by the pressing are eliminated.

10. A method of producing inkjet heads, comprising:

forming multiple ink channel units by bonding together each one of multiple sets of stacked channel plates by diffusion bonding;

forming multiple housings by bonding together each one of multiple sets of stacked housing plates by diffusion bonding; and forming multiple housing units by stacking and bonding together each one of pairs of the ink channel units and the housings by diffusion bonding, wherein the channel plates and the housing plates have substantially the same thickness.

11. A method of producing an inkjet head, comprising:

forming a nozzle unit by stacking a nozzle plate and a channel plate that are made of metal and by bonding together the stacked nozzle plate and the channel plate by diffusion bonding;

forming a nozzle hole in the nozzle plate of the formed nozzle unit by pressing or laser processing; and stacking and bonding together the nozzle unit, other channel plates, and housing plates, wherein the nozzle plate, the channel plate, the other channel plates, and the housing plates have substantially the same thickness.

* * * * *